US008782989B2

(12) United States Patent
Tang

(10) Patent No.: US 8,782,989 B2
(45) Date of Patent: Jul. 22, 2014

(54) NARROW LINED MODULAR FLOORING ASSEMBLIES

(75) Inventor: Yu Lin Tang, Shanghai (CN)

(73) Assignee: CoMc, LLC, Omaha, NE (US)

( * ) Notice: Subject to any disclaimer, the term of this patent is extended or adjusted under 35 U.S.C. 154(b) by 0 days.

(21) Appl. No.: 12/791,897

(22) Filed: Jun. 2, 2010

(65) Prior Publication Data

US 2010/0313510 A1 Dec. 16, 2010

Related U.S. Application Data

(60) Provisional application No. 61/186,283, filed on Jun. 11, 2009.

(51) Int. Cl.
*E04F 11/16* (2006.01)
*E04B 2/08* (2006.01)
*E04B 2/00* (2006.01)

(52) U.S. Cl.
USPC ..... 52/589.1; 52/181; 52/592.1

(58) Field of Classification Search
USPC ..... 52/403.1, 588.1, 578, 385, 384, 386, 52/387, 390, 391, 181, 589.1, 591.1, 592.1
See application file for complete search history.

(56) References Cited

U.S. PATENT DOCUMENTS

| | | | |
|---|---|---|---|
| 2,303,745 | A | 12/1942 | Karreman |
| 3,016,316 | A | 1/1962 | Olson |
| 3,535,844 | A | 10/1970 | Glaros |
| 3,553,921 | A | 1/1971 | Breistein |
| 3,676,970 | A | 7/1972 | Edwards |
| 3,723,233 | A | 3/1973 | Bourke |
| 3,828,503 | A | 8/1974 | Hoffman |
| 4,067,155 | A | 1/1978 | Ruff et al. |
| 4,095,388 | A | 6/1978 | Breault |
| 4,167,599 | A | 9/1979 | Nissinen |
| 4,226,064 | A | 10/1980 | Kraayenhof |
| 4,287,693 | A | 9/1981 | Collette |
| 4,453,365 | A | 6/1984 | Gladden |
| 4,550,543 | A | 11/1985 | Valenzano |
| 4,590,731 | A | 5/1986 | DeGooyer |
| 4,640,850 | A | 2/1987 | Marocco |
| 4,664,955 | A | 5/1987 | Clem |
| 4,807,412 | A | 2/1989 | Frederiksen |
| 4,840,825 | A | 6/1989 | Aristodimou |
| 4,877,672 | A | 10/1989 | Shreiner |

(Continued)

FOREIGN PATENT DOCUMENTS

| | | | |
|---|---|---|---|
| DE | 2246778 | B1 | 3/1974 |
| DE | 20009717 | A1 | 12/2000 |

(Continued)

OTHER PUBLICATIONS

Basil Katcheves, USPTO "Office Action for U.S. Appl. No. 12/433,844", Feb. 2, 2010.

(Continued)

*Primary Examiner* — Ryan Kwiecinski
(74) *Attorney, Agent, or Firm* — Edwin A. Sisson, Attorney at Law, LLC

(57) ABSTRACT

This specification describes a tray substrate for tile flooring that can be used in modular floating tile assemblies. The tray is made of plastic and has vertical tray edges recessed under the surface.

6 Claims, 9 Drawing Sheets

(56) References Cited

U.S. PATENT DOCUMENTS

| | | | | |
|---|---|---|---|---|
| 4,901,490 | A | 2/1990 | Zinniel et al. | |
| 4,917,532 | A | 4/1990 | Haberhauer et al. | |
| 4,930,279 | A | 6/1990 | Bart | |
| 4,931,331 | A | 6/1990 | Owens | |
| 5,052,158 | A | 10/1991 | D'Luzansky | |
| 5,103,614 | A | 4/1992 | Kawaguchi et al. | |
| 5,111,627 | A | 5/1992 | Brown | |
| 5,157,804 | A | 10/1992 | Williams | |
| 5,190,799 | A | 3/1993 | Ellingson | |
| 5,215,802 | A | 6/1993 | Sijpesteijn | |
| D347,722 | S | 6/1994 | Apps | |
| 5,323,575 | A * | 6/1994 | Yeh | 52/177 |
| 5,386,670 | A | 2/1995 | Tekeda et al. | |
| 5,418,036 | A | 5/1995 | Tokikawa et al. | |
| 5,616,389 | A | 4/1997 | Blatz | |
| 5,618,602 | A | 4/1997 | Nelson | |
| 5,678,369 | A | 10/1997 | Ishikawa et al. | |
| 5,678,380 | A | 10/1997 | Azzar | |
| 5,806,270 | A | 9/1998 | Solano | |
| 5,899,040 | A | 5/1999 | Cerrato | |
| 5,950,378 | A | 9/1999 | Council et al. | |
| 6,004,652 | A | 12/1999 | Clark | |
| 6,021,615 | A | 2/2000 | Brown | |
| 6,032,428 | A | 3/2000 | Rosan et al. | |
| 6,098,354 | A | 8/2000 | Skandis | |
| 6,127,015 | A | 10/2000 | Kessler | |
| 6,230,385 | B1 | 5/2001 | Nelson | |
| 6,247,286 | B1 | 6/2001 | Heyns | |
| 6,467,224 | B1 * | 10/2002 | Bertolini | 52/177 |
| 6,510,602 | B2 | 1/2003 | Sugiura | |
| 6,684,592 | B2 | 2/2004 | Martin | |
| 6,694,689 | B1 | 2/2004 | Scott et al. | |
| 6,694,691 | B2 * | 2/2004 | Ku | 52/403.1 |
| 6,802,159 | B1 | 10/2004 | Kotler | |
| 6,910,668 | B2 * | 6/2005 | Henning | 248/346.02 |
| 6,966,155 | B2 * | 11/2005 | Nevison | 52/177 |
| 7,188,817 | B2 * | 3/2007 | Henning | 248/346.02 |
| 7,543,417 | B2 * | 6/2009 | McIntosh et al. | 52/589.1 |
| 7,779,602 | B2 * | 8/2010 | Collison | 52/747.1 |
| 7,900,416 | B1 * | 3/2011 | Yokubison et al. | 52/592.1 |
| 8,186,116 | B2 * | 5/2012 | Anderson | 52/392 |
| 2002/0124506 | A1 * | 9/2002 | Mercade | 52/390 |
| 2002/0189176 | A1 | 12/2002 | Stegner et al. | |
| 2002/0189182 | A1 | 12/2002 | Record | |
| 2003/0074855 | A1 | 4/2003 | Nelson | |
| 2003/0097808 | A1 | 5/2003 | Sabatini | |
| 2003/0136070 | A1 * | 7/2003 | Ku | 52/403.1 |
| 2003/0154676 | A1 | 8/2003 | Schwartz | |
| 2003/0177728 | A1 * | 9/2003 | Ku | 52/403.1 |
| 2003/0233809 | A1 | 12/2003 | Pervan | |
| 2004/0074190 | A1 | 4/2004 | Lin et al. | |
| 2004/0139679 | A1 * | 7/2004 | Della Pepa | 52/578 |
| 2004/0187423 | A1 | 9/2004 | Weber | |
| 2004/0226242 | A1 | 11/2004 | Moller, Jr. | |
| 2005/0034395 | A1 | 2/2005 | Kotler | |
| 2005/0039413 | A1 | 2/2005 | Schrotenboer | |
| 2005/0144867 | A1 | 7/2005 | Clarke | |
| 2005/0144879 | A1 | 7/2005 | Fiorino | |
| 2005/0200062 | A1 | 9/2005 | Maurer et al. | |
| 2005/0208255 | A1 | 9/2005 | Pervan | |
| 2006/0230701 | A1 * | 10/2006 | Pepa | 52/592.1 |
| 2006/0265987 | A1 * | 11/2006 | Iannone | 52/384 |
| 2007/0039267 | A1 * | 2/2007 | Swanson | 52/391 |
| 2007/0094969 | A1 * | 5/2007 | McIntosh et al. | 52/386 |
| 2007/0094979 | A1 | 5/2007 | Richardson et al. | |
| 2007/0227090 | A1 | 10/2007 | Plante | |
| 2008/0078135 | A1 * | 4/2008 | McIntosh et al. | 52/396.1 |
| 2008/0092473 | A1 * | 4/2008 | Heyns | 52/385 |
| 2008/0173569 | A1 | 7/2008 | Forsyth | |
| 2008/0313987 | A1 * | 12/2008 | Ibanez et al. | 52/384 |
| 2009/0266019 | A1 * | 10/2009 | Mcintosh et al. | 52/415 |
| 2010/0257801 | A1 * | 10/2010 | Anderson | 52/391 |
| 2011/0113713 | A1 * | 5/2011 | Lui | 52/391 |

FOREIGN PATENT DOCUMENTS

| | | | | |
|---|---|---|---|---|
| DE | 19962812 | A1 | 6/2001 | |
| DE | 20205774 | U1 | 4/2002 | |
| DE | 202004017921 | U1 | 1/2005 | |
| DE | 102006021426 | A1 | 11/2007 | |
| EP | 0176645 | B1 | 10/1984 | |
| EP | 0256189 | B1 | 2/1988 | |
| EP | 0544604 | B1 | 2/1993 | |
| EP | 1039057 | A1 | 9/2000 | |
| EP | 1146182 | A1 | 10/2009 | |
| GB | 1350754 | A1 | 4/1970 | |
| GB | 2216976 | A | 10/1989 | |
| GB | 2284846 | A | 6/1995 | |
| GB | 2307489 | A | 5/1997 | |
| WO | 0008274 | A1 | 2/2000 | |
| WO | 0175247 | A1 | 10/2001 | |
| WO | 02101175 | A1 | 12/2002 | |
| WO | 03040491 | A1 | 5/2003 | |
| WO | 2004070134 | A1 | 8/2004 | |
| WO | 2004081316 | A1 | 9/2004 | |
| WO | 2005098164 | A1 | 10/2005 | |
| WO | 2009055852 | A1 | 5/2009 | |
| WO | WO 2009055852 | A1 * | 5/2009 | E04F 13/14 |

OTHER PUBLICATIONS

Edwin A. Sisson, "Response to Office Action for U.S. Appl. No. 12/433,844, Issued Feb. 2, 2010", Jul. 28, 2010.

James Ference, USPTO "Office Action for U.S. Appl. No. 11/839,443", Jul. 21, 2010.

James Ference, USPTO "Office Action for U.S. Appl. No. 11/839,443", Mar. 30, 2010.

Edwin A. Sisson, "Response to Office Action for U.S. Appl. No. 11/839,443, Issued Mar. 30, 2010", May 17, 2010.

James Ference, USPTO "Office Action for U.S. Appl. No. 11/839,443", Sep. 3, 2009.

Edwin A. Sisson, "Response to Office Action for U.S. Appl. No. 11/839,443, Issued Sep. 3, 2009", Nov. 25, 2009.

Basil Katcheves, USPTO "Office Action for U.S. Appl. No. 11/432,873", Sep. 19, 2008.

Basil Katcheves, USPTO "Office Action for U.S. Appl. No. 11/432,873", Jan. 16, 2008.

Glen H. Lenzen, Jr., "Amendment and Response to Office Action for U.S. Appl. No. 11/432,873, Issued Jan. 16, 2008", Jun. 16, 2008.

Yvonne Horton, USPTO "Office Action for U.S. Appl. No. 11/432,873", Mar. 22, 2007.

Glen H. Lenzen, Jr., "Amendment and Response to Office Action for U.S. Appl. No. 11/432,873, Issued Mar. 22, 2007", Jun. 22, 2007.

Edwin A. Sisson, "Response to Office Action for U.S. Appl. No. 11/839,443, Issued Jul. 21, 2010", Nov. 22, 2010.

Edwin A. Sisson, "Response to Office Action for U.S. Appl. No. 11/432,873, Issued Sep. 19, 2008", Nov. 26, 2008.

Edwin A. Sisson, "Amendment and Response to Office Action for U.S. Appl. No. 12/433,844, Issued Oct. 12, 2010", Dec. 4, 2010.

Basil Katcheves, USPTO "Office Action for U.S. Appl. No. 12/433,844", Oct. 12, 2010.

Joshua Ihezie, USPTO "Office Action for U.S. Appl. No. 11/137,705", Sep. 17, 2008.

Christopher A. Eusebi, "Response to Office Action for U.S. Appl. No. 11/137,705, Issued Sep. 17, 2008", Dec. 17, 2008.

Joshua Ihezie, USPTO "Office Action for U.S. Appl. No. 11/137,705", Feb. 17, 2009.

Edwin A. Sisson, "Response to Office Action for U.S. Appl. No. 11/137,705, Issued Feb. 17, 2009", May 15, 2009.

Basil Katcheves, USPTO "Advisory Action for U.S. Appl. No. 12/433,844", Dec. 16, 2010.

James Ference, USPTO "Final Office Action for U.S. Appl. No. 11/839,443", Jan. 7, 2011.

* cited by examiner

NARROW LINED MODULAR FLOORING ASSEMBLIES

PRIORITY AND CROSS REFERENCES

This application claims priority from U.S. Provisional Patent Application No. 61/186,283 filed 11 Jun. 2009, the teachings of which are incorporated in their entirety.

FIELD OF THE INVENTION

The present invention relates to a modular flooring assembly including a flooring component adhered to a tray substrate.

BACKGROUND OF THE INVENTION

United States Patent Publication 2007009469 teaches the use of a tray substrate and a flooring component to create a floating tile structure. The trays interlock with each other as demonstrated in FIG. 17 of that specification. U.S. Pat. No. 7,197,855 teaches the use of a tray substrate with a flooring component attached that is interlocked as well.

Both of these systems provide for interlocks between the tray that completely extend from the side of the tray. Generally these interlocks set the size of the gap between the trays. One can make the gaps narrow by reducing the size of the locking mechanisms. However, reducing the size of the locking mechanism reduces the strength of the lock and also leads to breakage of the interlocks during installation due to their small size.

There exists therefore a need for a tray substrate system which can provide strength and size of the interlocking mechanism yet maintain a small gap between the tiles attached to the interlocked tray substrate.

SUMMARY OF THE INVENTION

The present invention relates to a modular flooring assembly including an optional flooring component such as a tile adhered to a tray substrate. The modular flooring assembly may be interconnected with additional modular flooring assemblies to form a modular floor suitable for most flooring applications. The flooring component may comprise tile or wood or other materials commonly used in flooring applications. Conventional fill-in grout or a snap-in grout may be used with the modular flooring assemblies.

Disclosed in this application is a component of a flooring system comprising Which is a tray substrate comprising a tray substrate surface which is an upward facing horizontal surface having a tray substrate surface perimeter, a tray substrate bottom with a padding attached to the tray substrate bottom, a plurality of tray substrate vertical tray edges which protrude upward and extend along the tray substrate surface perimeter, a plurality of tray substrate edges defining an outside perimeter of the tray substrate, the tray substrate edges having a plurality of upward tabs comprising a surface and a valley and a plurality of downward tabs comprising a surface and a lip, wherein at least a portion of the downward tab is recessed under the upward facing horizontal tray surface. It is further disclosed that the tray substrate may have a flooring component adhered to the tray substrate surface with an adhesive.

It is further disclosed that the flooring component may be selected from the group consisting of tile, stone, marble, wood, ceramic tile, porcelain tile, and granite. It is also further disclosed that the flooring component may be smaller than the tray substrate surface. It is also further disclosed that the tray substrate vertical tray edges may run the entire perimeter of the tray substrate surface

DETAILED DESCRIPTION OF PREFERRED EMBODIMENTS

Figure 1:
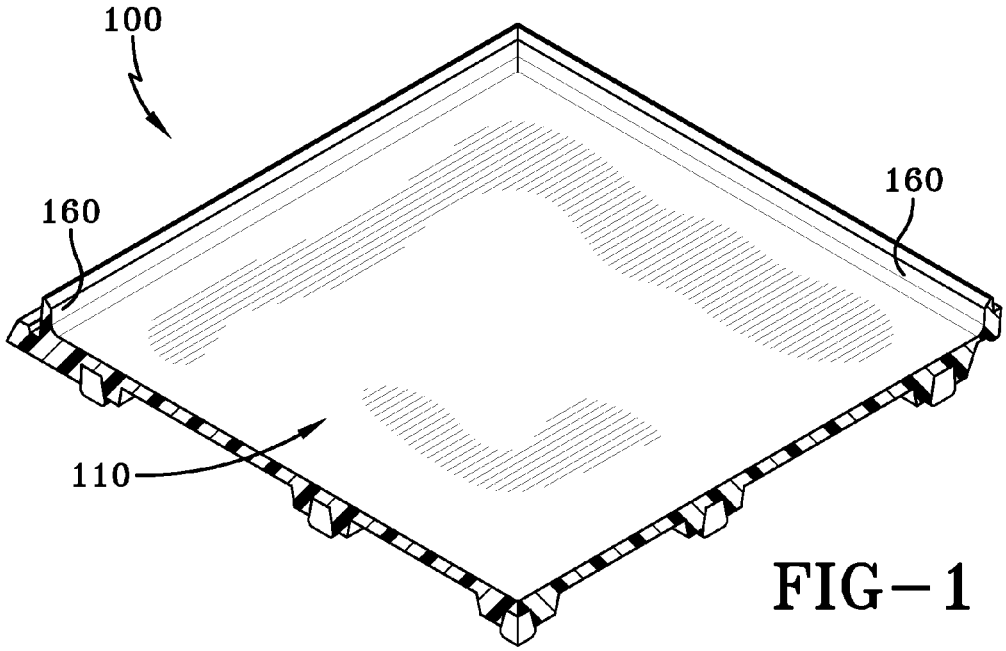
FIG. 1 is a perspective view of the tray substrate.

The present invention relates to a modular flooring assembly including a flooring component adhered to a tray substrate. The modular flooring assembly may be interconnected with additional modular flooring assemblies to form a modular floor suitable for most flooring applications. The flooring component may comprise tile or wood or other materials commonly used in flooring applications. The tray substrate comprises tabs, which provide for the tray substrates to interlock with tabs from an adjacent tray substrate. The fully assembled modular floor provides the appearance of a conventional floor. Fill-in grout or a snap-in grout may be used with the modular flooring assemblies.

The modular floor may be quickly disassembled and does not damage the sub floor, as the modular floor is not typically attached to the sub floor by adhesives, grout compounds, or other fastening means. Further, the modular floor may be installed over an existing sub floor without the installation of a concrete backer board, which is commonly used in ceramic tile installation.

The tray substrate holds the flooring component on its tray surface. The tray surface is an upward facing horizontal surface with vertical tray edges which protrude upward around the perimeter of the tray surface and outline the perimeter of the tray surface.

The tray surface may be generally flat, or may contain a pattern designed to enhance adhesive performance between the tray surface and the flooring component. The tray surface pattern may be designed to complement the bottom of the flooring component; for example, tiles may have different mold patterns on their bottom depending upon the manufacturer's design. The tray surface may also be solid, or may have holes therein. The holes may be added in appropriate locations to aid in moisture evaporation without compromising adhesive performance.

The vertical tray edges are designed to ensure substantially exact, or exact, alignment of the flooring component with the tray surface, and help provide a barrier to ensure adhesive can be applied over the entire bottom of the flooring component without the adhesive being pushed or flowing into the tab areas. If adhesive is allowed to enter the tab areas, their interlocking connection may be physically impaired by adhesive residue. The vertical tray edges do not have to run the entire perimeter of the tray substrate, but preferably should run the entire perimeter of the tray substrate. The inside of the vertical tray edges define an area smaller than the perimeter of the tray substrate. The flooring component is set inside the wall defined by the vertical tray edges and is adhered to the tray surface defined by the inside wall of the vertical tray edges.

By their vertical orientation, the tray edges positionally hold the flooring component and, in combination with the adhesive, reduce lateral movement. The tray edges may provide a further surface for the adhesive to adhere the side of the flooring component. The tray surface joins to the bottom of the flooring component via the adhesive and the tray edges join to the sides of the flooring component via the adhesive. The combination of the adhesive on the tray surface and the adhesive on the tray edges provide a secure hold for the flooring component. This insures that the flooring component is locked down to the tray substrate, and the flooring component does not slip or move.

The size of the tray substrate and the flooring component are strictly controlled to insure that the flooring component fits securely in the tray substrate. The flooring component should just fit onto the tray surface and rest snugly against the vertical edges. The flooring component should be slightly smaller than the tray surface defined by the vertical tray edges.

The present invention achieves significant advantages. A tray with four vertical tray edges, improves the structural rigidity of the tray. The four tray edges prevent adhesive from pushing into the interlocking tabs. In other systems, the adhesive can push into the tab area causing interference with the other tile. The four tray edges help align the flooring component to the tray, which improves assembly ease and quality. In other systems, the flooring surface is not constrained and therefore must be held in place until the adhesive has cured.

There are upward and downward facing tabs located on all sides of the tray substrate. The upward and downward orientation is based upon the tray bottom and the upward facing tray surface. The upward and downward tabs should alternate on each edge of the tray substrate, but they do not have to alternate. For example, there could be two downward tabs, one upward tab and two downward tabs. For most flooring applications, the use of 6, 8, or 10 tabs per edge, half of each orientation, provide satisfactory performance. In other embodiments, there may be fewer or additional tabs. The tabs do not necessarily have to alternate. In practice, it has been found that the number of tabs be in multiples of four.

The upward tab comprises a surface and a valley. The shape of the surface could be convex. The downward tab includes a surface and a lip. The shape of the surface may be concave. As the downward tab is urged against the upward tab, the upward tab flexes as the lip slides over the convex surface and into the valley, such that the lip snaps into the valley and the concave surface presses over the convex surface. This provides a connection with sufficient rigidity to create a composite floor made of multiple modular flooring assemblies.

In order to provide the narrow grout line, or gap between the two interconnected tray substrates, the downward facing tab does not extend from the side of the tray substrate. Rather, the downward tab extends from a recessed area in the side of the tray substrate. The length of the recessed area as measured along the side of the tray substrate is at least slightly longer than the upward facing tab so that the upward tab can fit into the recessed area and under the tray surface, and that at least a portion of the valley of the downward tab is aligned underneath the horizontal tray surface. In one embodiment, a portion of the lip of the downward tab is directly beneath the vertical tray edge. In another embodiment only the upward facing tab is recessed into the tray edge. In yet another embodiment, both tabs are recessed into the tray edge.

The modular flooring assembly is designed such that even if one or more tabs are broken on a given side, the tray substrates will still interlock. This also allows the modular flooring assemblies to be cut to a specific size and to still interlock.

The interlocking tabs may be positioned such that the modular flooring assemblies are offset supporting various decorative patterns.

The interlocking tabs on one modular flooring assembly need not be perfectly aligned with the other modular flooring assembly to allow "fine-tuning" of the relative tile position.

The bottom of the tray, i.e., opposite of the tray surface, is designed as the foundation of the system. The bottom may include structural webbing to strengthen the tray bottom ensuring the tray surface remains relatively flat.

The bottom of the tray may also include an optional non-skid and noise deadening padding of an over-molded, rubber-like material, such as thermoplastic rubber or thermoplastic elastomer. A particularly preferred thermoplastic elastomer is SANTOPRENE®. The padding provides a cushion for the flooring system. The padding also provides a non-skid element that prevents the flooring system from sliding on the underlying flooring material. The padding also provides some level of flex in the presence of underlying floor surface imperfections or heavy surface loads. The padding also helps reduce vibration transmission, thus providing a sound-deadening function.

As described above, various type of grout may be used in the present invention, including the snap-in grout or a fill-in grout compound that is spread into the gaps between neighboring trays.

Fill-in grouts may also be used with the trays. Fill-in grouts may be packaged in a powdered or granular form. The user mixes the powder or granules with a liquid to form a plastic material that is spread in between the modular flooring assemblies. Other fill-in grout compounds are packaged in a ready to spread form. The modular flooring assemblies are snapped together and the fill-in grout material is used to fill the space between the modular flooring assembly. The fill-in grout material must remain semi-flexible once cured since the floor "floats." The separate grout material must also have good adhesive qualities to ensure the material adheres to the sides of the modular flooring assemblies. Acrylic, urethane, epoxy, and latex modified grouts are suitable.

The flooring component may comprise tile, stone, marble, wood, or other conventional flooring materials. The flooring component could be a ceramic or porcelain tile, a natural stone product like marble or granite, or could be a wooden product.

The flooring component is adhered to the tray surface and tray edges using a variety of commercially available adhesives. Suitable adhesives for use with the present invention include a two-part epoxy using a methacrylate material, silicone, rubber based and urethane based. Other urethane adhesives may also be utilized. The specific selection of the adhesive will depend on the nature and properties of the flooring component. The methacrylate adhesive is preferred for ceramic tile. The tray edges define a space to receive the flooring component.

The present invention, by using a snap-in grout that is not permanently integrated with the tray, achieves advantages. The consumer may choose from among many different snap-in grout colors. Damaged snap-in grout can be easily replaced. Snap-in grout may also be changed to reflect different decorating tastes. Finally, flexibility is provided to either use snap-in grout or a fill-in grout.

The tray may be made using injection molding of a suitable plastic resin. High impact polystyrene is preferred, but other plastic resins including polypropolene and ABS may be used.

The padding of the non-skid and noise deadening material may be a thermoplastic rubber, thermoplastic elastomer, or other softer plastic material including SANTOPRENE®. The padding is over-molded to the base of the tray. An adhesive is applied between the tray surface and the bottom of the flooring surface.

Multiple adhesive materials and application patterns can be used depending upon the combination of plastic resin used for the tray, the flooring material, and the profile of the flooring material. For tile application, adhesive is applied to the ridge-lines on the bottom of the tile to maximize contact with the tray surface. Robotics may be used to improve the precision and efficiency of the assembly process. Robotics may also be used to package and palletize the finished products.

The modular flooring assemblies of the present invention may be used in almost any sized embodiment, including 6-inch, 6½-inch, 12-inch, and 13-inch embodiments. The modular flooring assemblies have a square or rectangular shape. The square shaped modular flooring assemblies have four sides of equal length. Other sizes may be used, however these sizes are generally used in the flooring industry. Further, a combination of the 6-inch and 12-inch modular flooring assemblies may be used in combination to provide a unique appearance. The present invention may be further modified to include other combinations of different sized modular flooring assemblies.

During use of the present invention, the modular flooring assemblies are snapped together to form an overall flooring surface. The fill-in grout material may be applied between the modular flooring assemblies, or the snap-in grout may be installed. In order to accommodate different rooms of varying sized and shapes, the modular flooring assemblies can be cut using a wet saw if tile or stone is the flooring component or using a table or a circular saw for wooden flooring components.

The underlying flooring surface should be free of major surface variations, but need not be in perfect condition. No special floor preparation is required to ensure the tiles are fixed since the interlocking modular flooring assemblies will "float" and flex. The system can be installed directly on top of finished wood, linoleum, other tile, concrete, plywood, or a variety of other flooring systems. The modular flooring assemblies can be installed on top of padding or other underlayment material if an additional measure of insulation or padding is desired. The modular flooring assemblies can be installed on top of radiant-type heating systems as well.

The present invention will now be described with reference to the Figures:

FIG. 1 shows tray 100 having a tray surface 110 with vertical tray edges 160. The tray surface 110 receives the flooring component 600, which in this embodiment is a ceramic tile.

Figure 2:
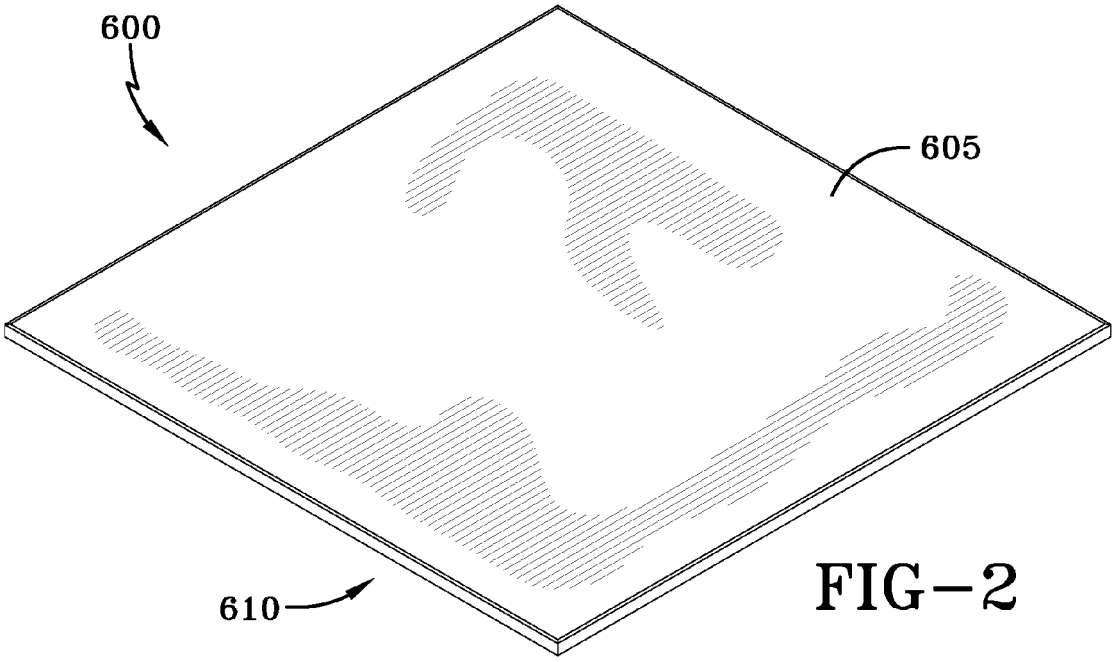
FIG. 2 is a perspective view of a flooring component.

FIG. 2 shows the flooring component 600. A top surface 605 of the flooring component 600 forms the floor surface. A bottom surface 610 of the flooring component 600 is adhered to the tray surface 110 by an adhesive. Although in this embodiment the flooring component 600 is a ceramic tile, the flooring component may be made from any flooring material.

Raised edges 160 of the tray surface 110 help secure the flooring component 600 and prevent adhesive from leaking from the tray surface 110. The raised edges 160 are shorter than the height of the flooring component 600. Preferably the raised edges 160 completely surround the flooring component 600.

Figure 3:
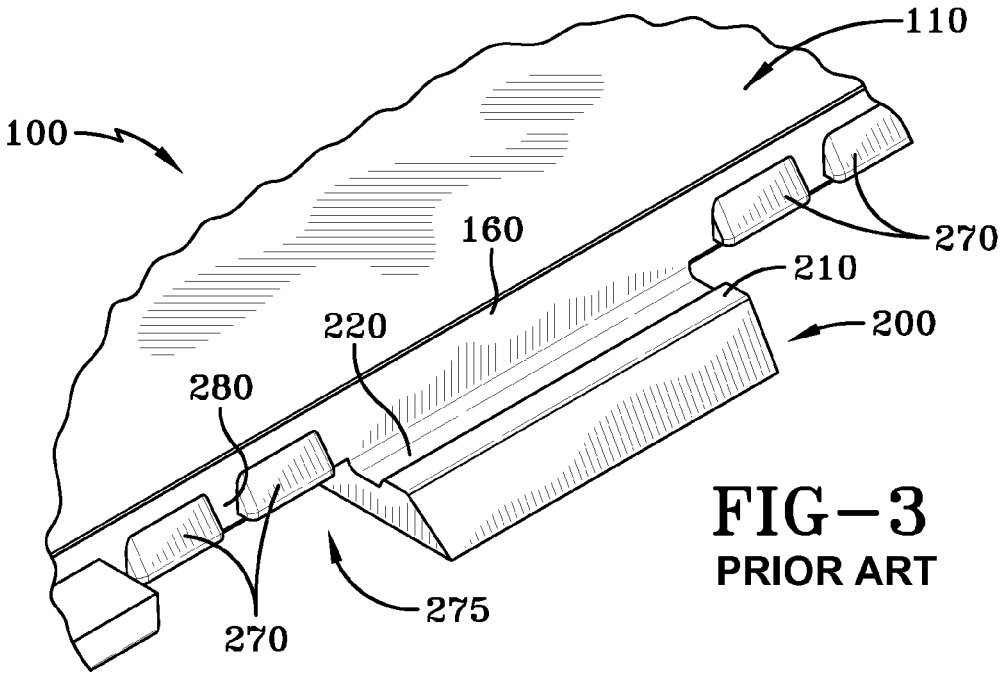
FIG-3 PRIOR ART
FIG. 3 is a perspective view of the prior art interconnect upward facing tab.
Figure 4:
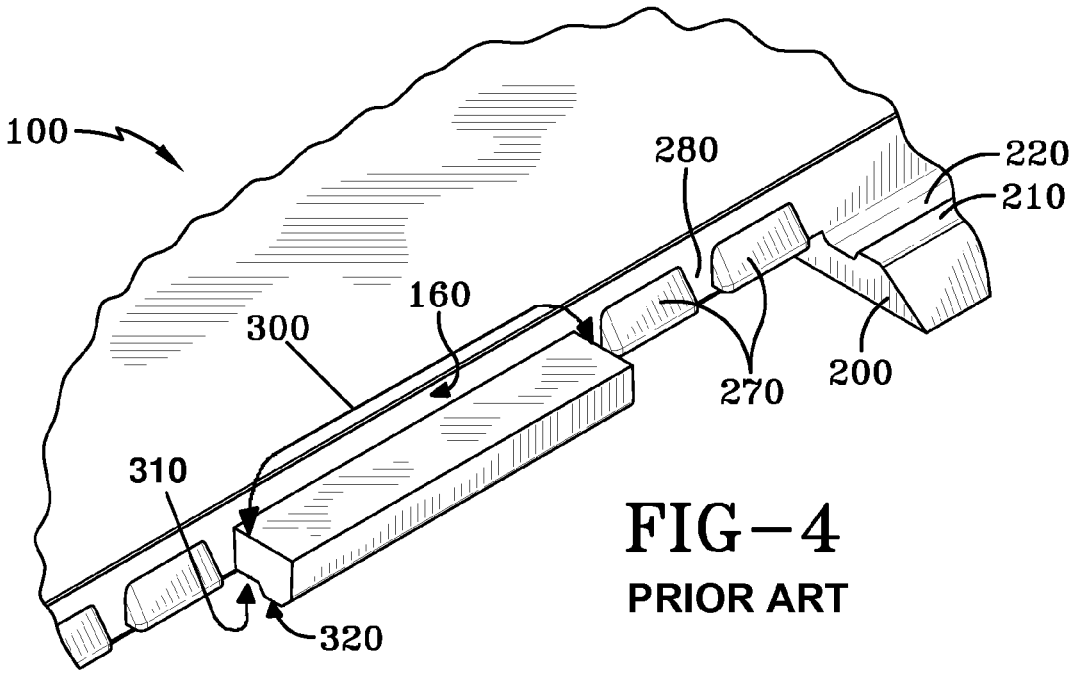
FIG-4 PRIOR ART
FIG. 4 is a perspective view of the prior art interconnect upward and downward facing tabs.
Figure 4A:
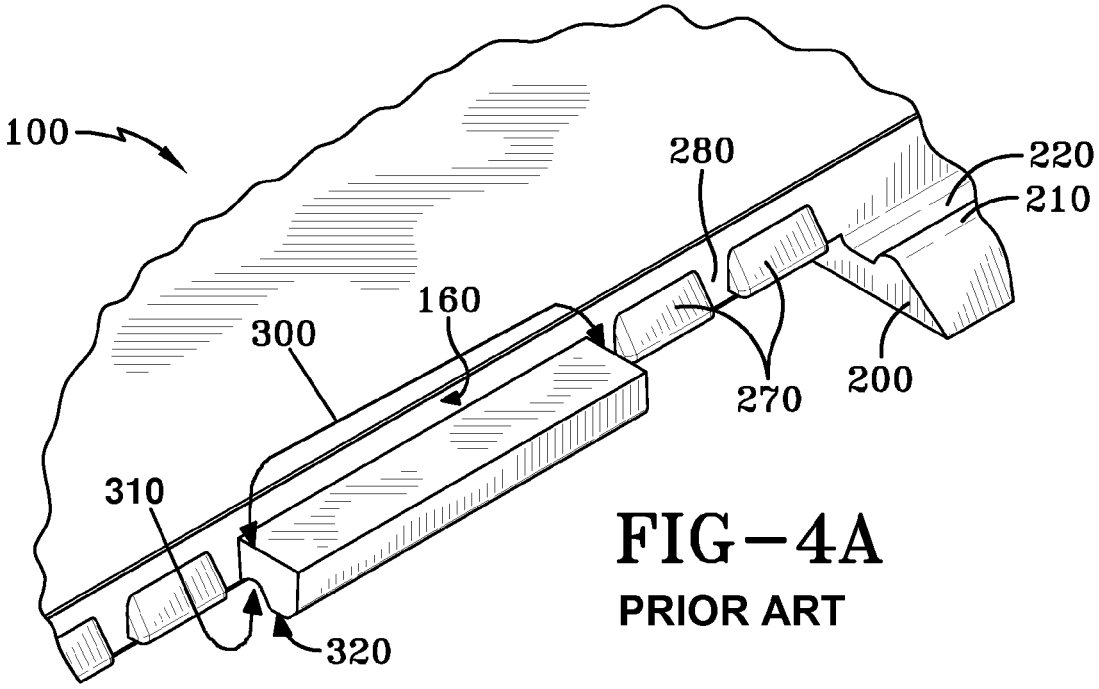
FIG-4A PRIOR ART
Figure 5:
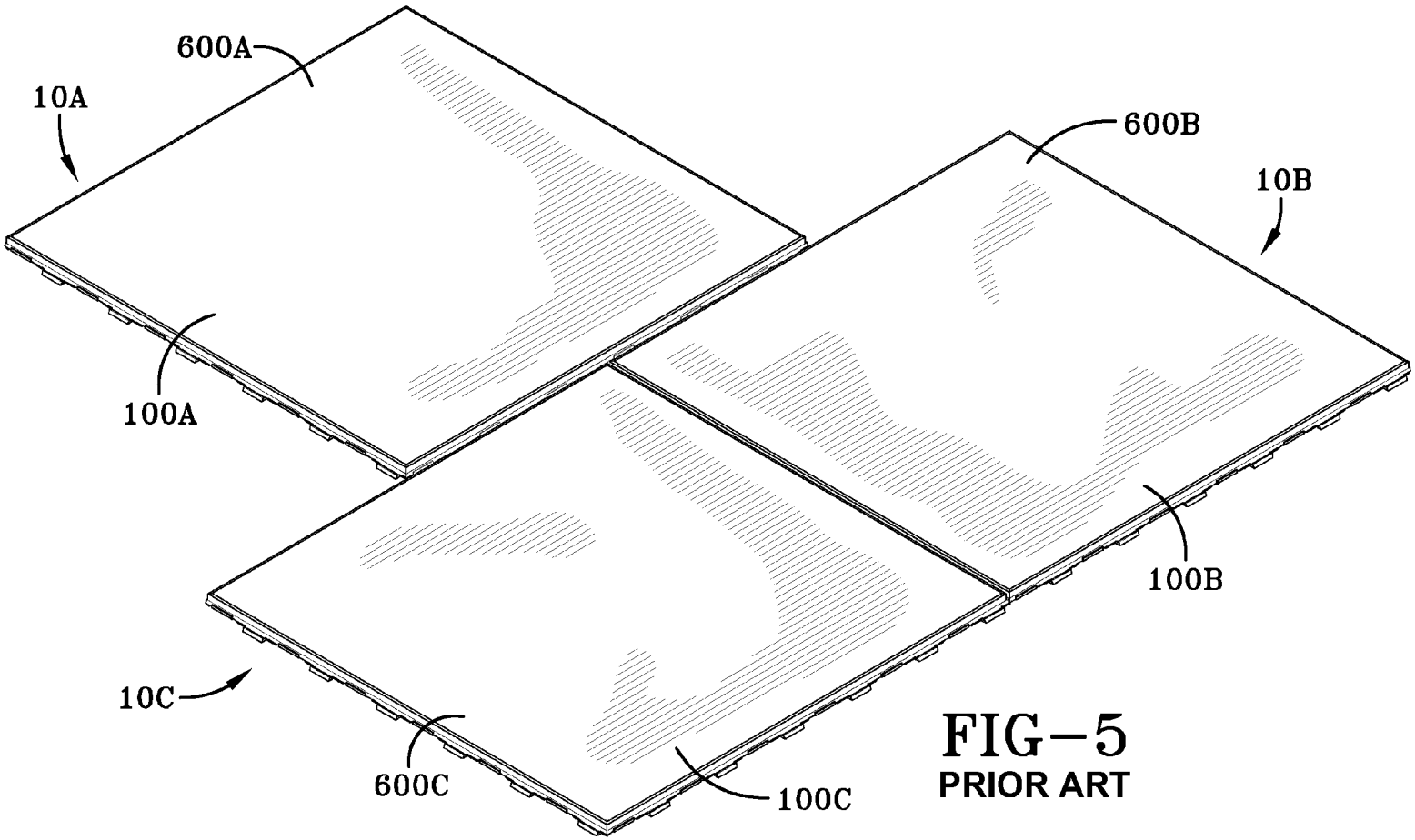
FIG—5 PRIOR ART
FIG. 5 shows three modular flooring assemblies assembled.

FIGS. 3-5 show the interconnecting members of the prior art. A perimeter of the tray 100 is provided with a plurality of upward tabs 200 and a plurality of downward tabs 300. The upward tabs 200 interact with downward tabs 300, and the downward tabs 300 interact with the upward tabs 200 on an adjacent modular flooring assemblies 100. This provides the interconnection between adjacent modular flooring assemblies 10A, 10B, and 10C of FIG. 5.

In this embodiment of the prior art, the tray 100 is provided with a total of six upward tabs 200 and downward tabs 300 per side of the tray 100. The tray 100 is designed to form a 12-inch flooring assembly, and more or less tabs may be utilized in larger modular flooring assemblies and smaller modular flooring assemblies.

As shown in FIG. 3, the upward tab 200 includes a convex surface 210 and a valley 220. As shown in FIG. 4, the downward tab 300 includes a concave surface 310 and a lip 320. As the downward tab 300 is urged against the upward tab 200, the downward tab 300 flexes as the lip 320 slides over the convex surface 210 and into the valley 220, such that the lip 320 snaps into the valley 220 and the concave surface 310 presses over the convex surface 210. This provides a connection with sufficient rigidity to create a composite floor made of multiple modular flooring assemblies. 270 are grout holders and are on all sides of the tray substrate angling downward and away from the edge of the tray in the downward direction. 280 is the space between the grout holders. 275 is the bottom of the grout holder.

Although FIG. 3 shows the grout holders, the grout holders are optional and there are embodiments which would not have any grout holders, or may only have one grout holder.

Moreover, the interlocking connection between the downward tab 300 and the upward tab 200 may be separated such that the composite floor may be disassembled. This allows the user to change flooring as desired. Generally, the application of the modular flooring assemblies will not harm the sub floor.

FIG. 5 shows three of the prior art tray assemblies interlocked. 10A, 10B, and 10C are the interlocked tray assemblies. 600A, 600B, and 600C are the respective flooring components and 100A, 100B, and 100C are the respective tray substrates.

FIGS. 6-9 show the embodiment of the interlocks which permit the narrow gap between the interlocked tiles. Using the same numbering conventions as the prior art, the tray substrate 100 is provided with upward tabs 200 and downward tabs 300.

Figure 6:
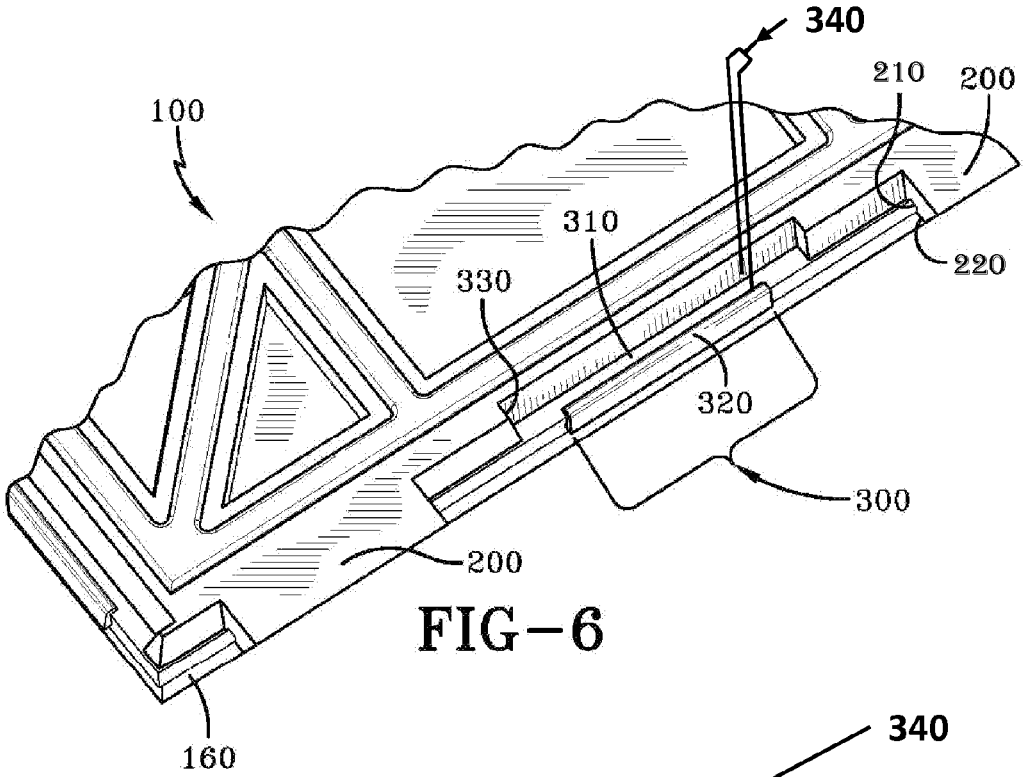
FIG. 6 is a perspective view of the recessed interconnect.
Figure 7:
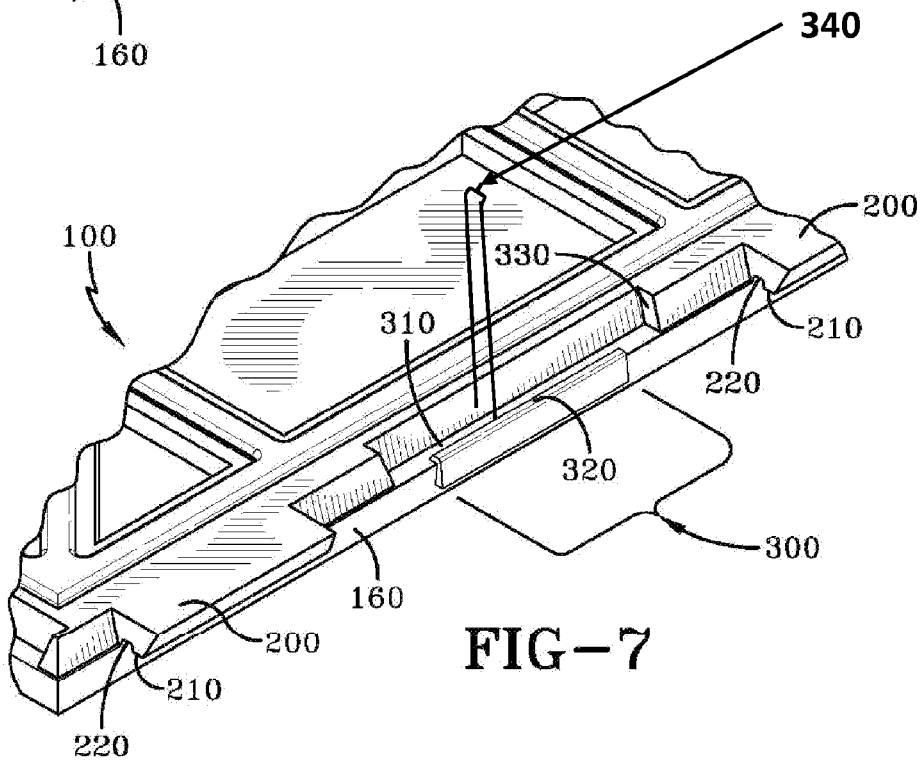
FIG. 7 is a side view of the recessed interconnect.
Figure 8:
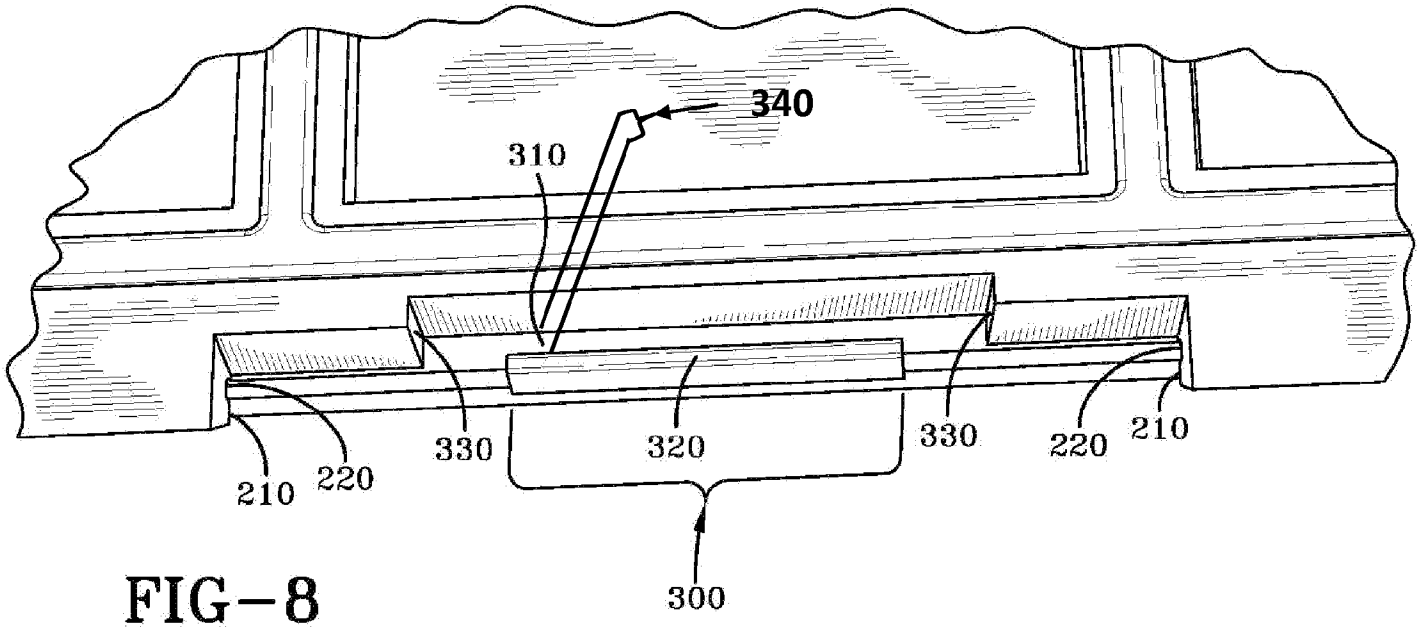
FIG. 8 is a bottom view of the recessed interconnect.
Figure 9:
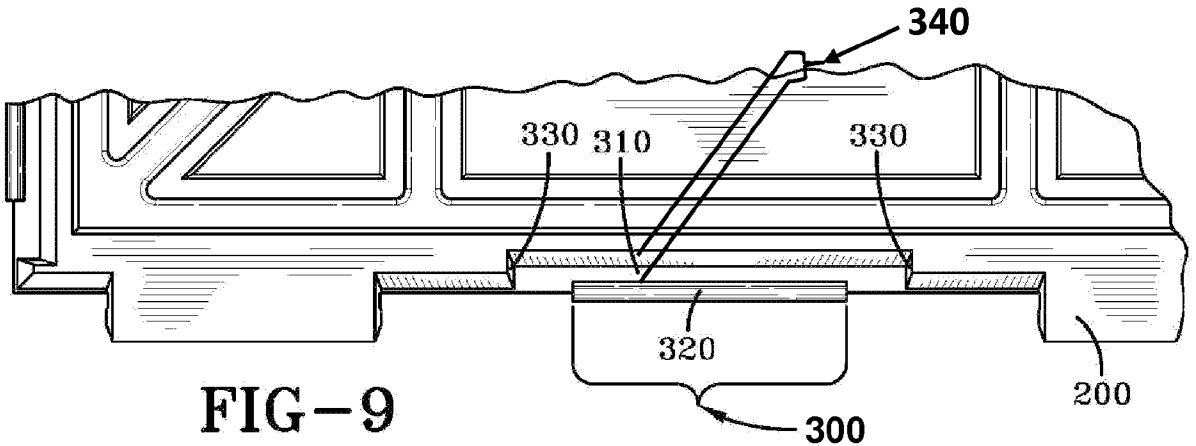
FIG. 9 is a bottom view of the recessed interconnect.

As shown in FIG. 6, the upward tab 200 includes a convex surface 210 and a valley 220. The downward tab 300 includes a concave surface 310 and a lip 320. As the downward tab 300 is urged against the upward tab 200, the downward tab 300 flexes as the lip 320 slides over the convex surface 210 and into the valley 220, such that the lip 320 snaps into the valley 220 and the concave surface 310 presses over the convex surface 210.

The thin grout line is achieved by the fact that the channel 315 is recessed into the wall of the tray substrate 330 and underneath the tray surface. Depending upon the width of the grout line desired, 310 or at least a portion of 320 would lie directly under the vertical tray edge 160.

Figure 10:
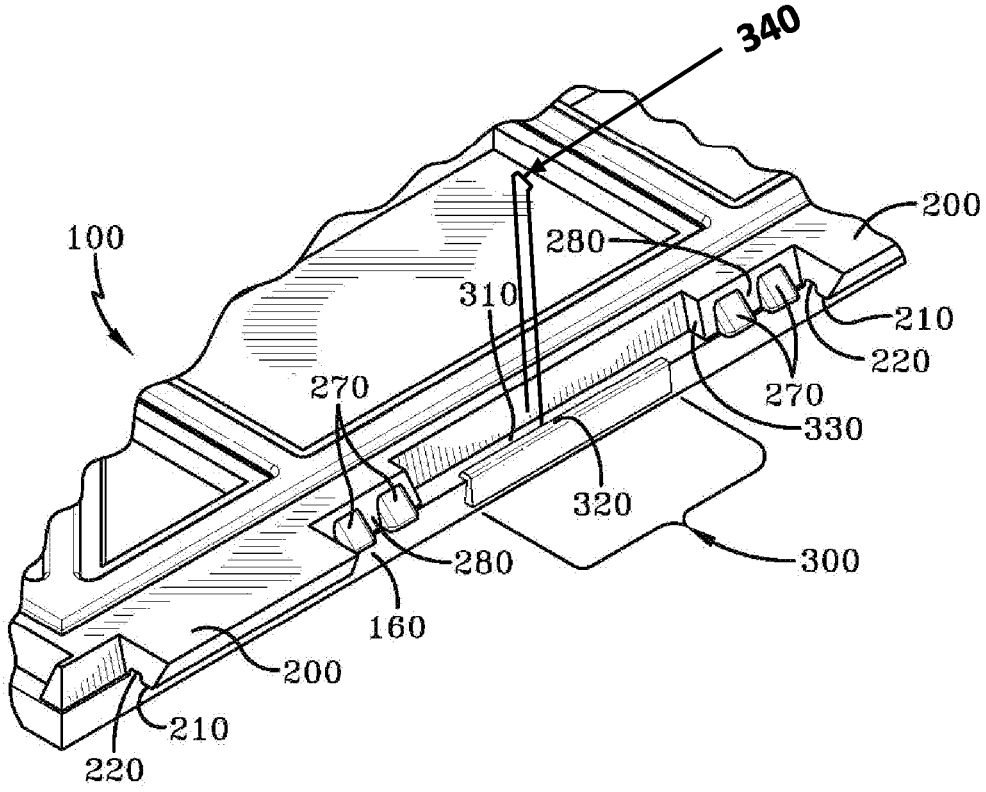
FIG. 10 is a bottom view of the recessed interconnect with grout holders on the perimeter.

As in the prior art, there may also be grout members protruding from the edge of the tray substrate. This is shown in FIG. 10 with grout holders 270 and the gap between them 280.

Figure 11:
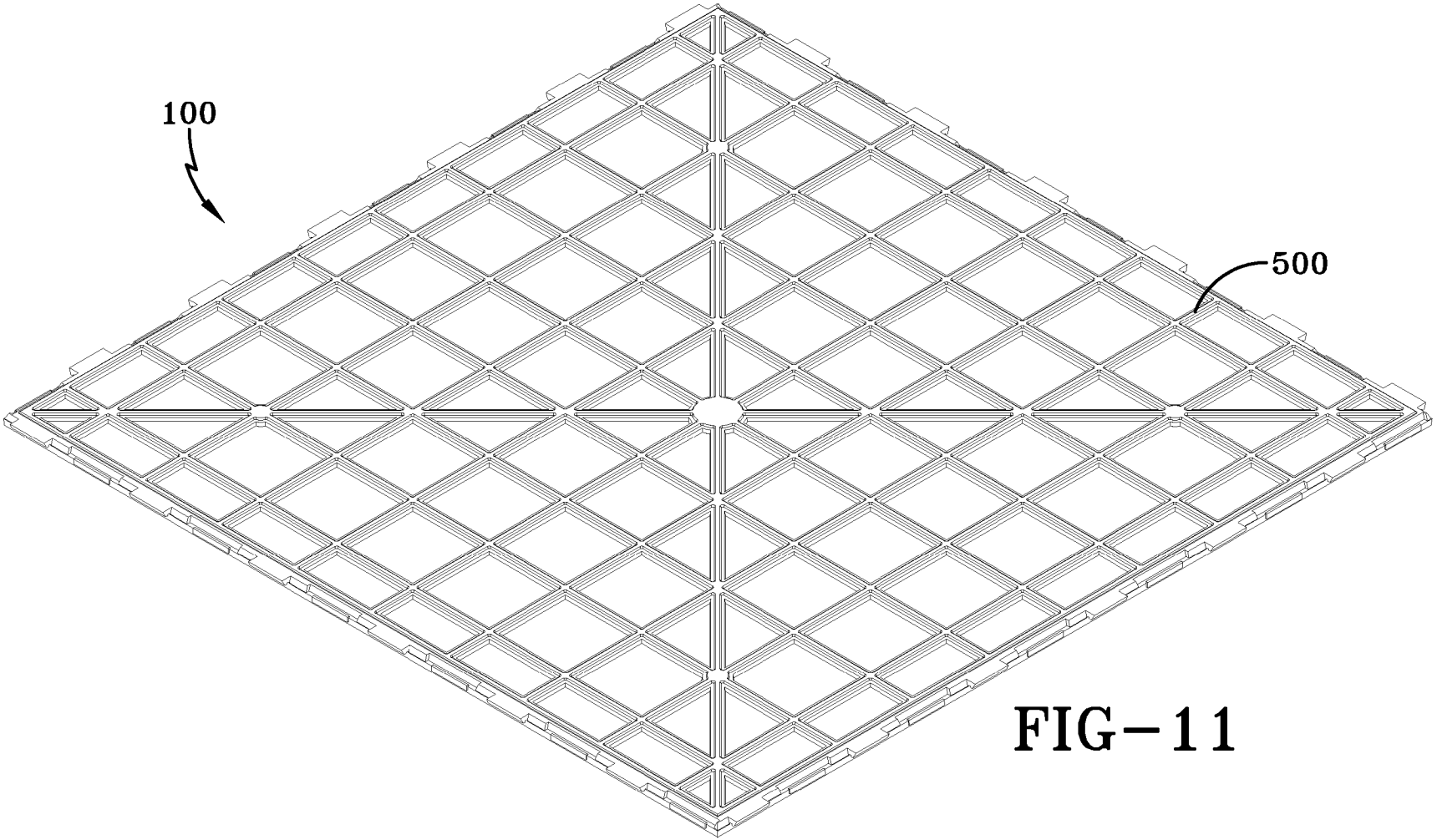
FIG. 11 is the back of the tray showing the pad.

An optional padding 500 is shown in FIG. 11. The padding 500 may be over-molded to the tray bottom.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Figure 12:
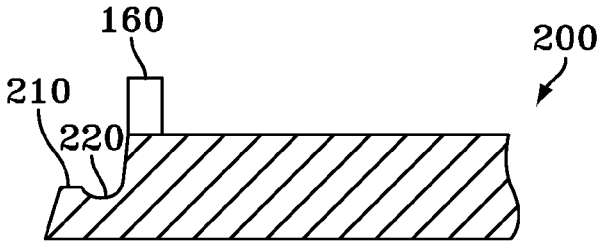
FIG. 12 is a cross section of the tray showing the downward tab.
Figure 13:
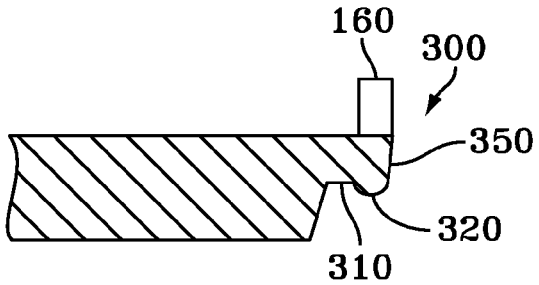
FIG. 13 is a cross section of the tray showing the upward tab.
Figure 14:
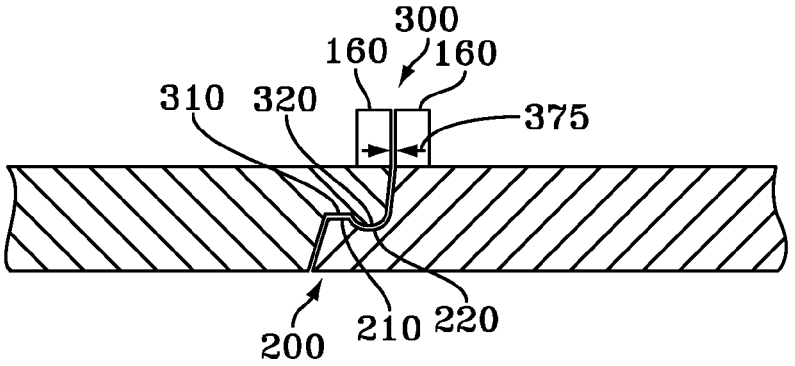
FIG. 14 is a cross section of two tray substrates joined together at an upward and downward tab.
Figure 15:
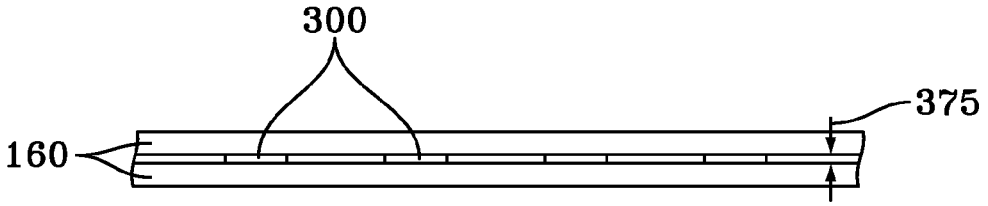
FIG. 15 is a top view of two tray substrates joined together

As shown in FIG. 12, the upward tab 200 includes a convex surface 210 and a valley 220. As shown in FIG. 13, the downward tab 300 includes a concave surface 310 and a lip 320. As further shown in FIG. 13, at 350 a portion of the downward tab protrudes away from the vertical tray edge 160 to create a portion of the grout line. As shown in FIG. 14 and FIG. 15, the downward tab 300 and the upward tab 200 are joined such that the lip 320 snaps into the valley 220 and the concave surface 310 presses over the convex surface 210. When the downward tab and the upward tab are joined the space between the vertical tray edges 160 forms the grout gap for the grout indicated by the arrow marked 375. For convenience, FIG. 12, FIG. 13 and FIG. 14 show only the cross sectional view of the downward tab and/or the upward tab. Objects residing behind the downward tab and/or the upward tab are omitted.

As shown in FIG. 12, the upward tab 200 includes a convex surface 210 and a valley 220. As shown in FIG. 13, the downward tab 300 includes a concave surface 310 and a lip 320. As further shown in FIG. 13, at 350 a portion of the downward tab protrudes away from the vertical tray edge 160 to create a portion of the grout line. As shown in FIG. 14 and FIG. 15, the downward tab 300 and the upward tab 200 are joined such that the lip 320 snaps into the valley 220 and the concave surface 310 presses over the convex surface 210. When the downward tab and the upward tab are joined the space between the vertical tray edges 160 forms the grout gap for the grout indicated by the arrow marked 375. For convenience, FIG. 12, FIG. 13 and FIG. 14 show only the cross sectional view of the downward tab and/or the upward tab. Objects residing behind the downward tab and/or the upward tab are omitted.

I claim:

1. A component of a flooring system comprising
a flooring component,
an adhesive,
a tray substrate comprising
a tray substrate surface which is an upward facing horizontal surface having a tray substrate surface perimeter,
a tray substrate bottom with a padding attached to the tray substrate bottom,
a plurality of tray substrate vertical tray edges which protrude upward and extend along the tray substrate surface perimeter,
a plurality of tray substrate edges defining an outside perimeter of the tray substrate,
wherein the tray substrate edges comprises a plurality of upward tabs comprising a convex surface and a valley;
the tray surface substrate further comprising a plurality of downward tabs comprising a concave surface and a lip, wherein at least a portion of each of the downward tabs is recessed under the upward facing horizontal tray surface, wherein at least a portion of the lip of the downward tab is directly beneath the vertical tray edge and said flooring component is adhered to the tray substrate surface with the adhesive.

2. The component of a flooring system of claim 1 wherein the flooring component is selected from the group consisting of tile, stone, marble, wood, ceramic tile, porcelain tile, and granite.

3. The component of claim 2, wherein the flooring component is smaller than the tray substrate surface.

4. The component of claim 1, wherein the flooring component is smaller than the tray substrate surface.

5. A component of a flooring system comprising
a tray substrate having
a tray substrate surface which is an upward facing horizontal surface,
a tray substrate bottom with a padding attached to the tray substrate bottom,
a plurality of vertical tray edges which protrude upward and extend around a perimeter of the tray substrate surface,
a plurality of tray substrate edges defining an outside perimeter of the tray substrate,
the tray substrate edges having a plurality of upward tabs comprising a convex surface and a valley;
the tray substrate edges further comprising a plurality of downward tabs comprising a concave surface and a lip, wherein at least a portion of each of the downward tab is recessed under the upward facing horizontal tray surface, and wherein at least a portion of the lip of the downward tab is directly beneath the vertical tray edge.

6. The component of claim 5, wherein the vertical tray edges run the entire perimeter of the tray substrate surface.

* * * * *